US011127276B2

(12) United States Patent
Prokes

(10) Patent No.: US 11,127,276 B2
(45) Date of Patent: Sep. 21, 2021

(54) EMERGENCY ALARM SYSTEM FOR RESTRICTED SPACES

(71) Applicant: James Michael Prokes, New Prague, MN (US)

(72) Inventor: James Michael Prokes, New Prague, MN (US)

( * ) Notice: Subject to any disclaimer, the term of this patent is extended or adjusted under 35 U.S.C. 154(b) by 0 days.

(21) Appl. No.: 17/160,308

(22) Filed: Jan. 27, 2021

(65) Prior Publication Data

US 2021/0150875 A1 May 20, 2021

Related U.S. Application Data

(60) Provisional application No. 62/966,497, filed on Jan. 27, 2020.

(51) Int. Cl.

| | |
|---|---|
| ***G08B 21/14*** | (2006.01) |
| ***G08B 7/06*** | (2006.01) |
| ***G08B 25/10*** | (2006.01) |

(52) U.S. Cl.

CPC ..... *G08B 21/14* (2013.01); *G08B 7/06* (2013.01); *G08B 25/10* (2013.01)

(58) Field of Classification Search

CPC ..... G08B 21/14; G08B 25/10; G08B 7/06
See application file for complete search history.

(56) References Cited

U.S. PATENT DOCUMENTS

| | | | | |
|---|---|---|---|---|
| 5,835,013 | A * | 11/1998 | Duterte | G08B 13/1427 340/539.23 |
| 7,174,176 | B1 * | 2/2007 | Liu | H04W 88/02 455/404.1 |
| 8,334,785 | B1 * | 12/2012 | Zetts | G08B 7/064 340/691.5 |
| 10,510,239 | B1 * | 12/2019 | Trivedi | G08B 25/006 |
| 2002/0106202 | A1 * | 8/2002 | Hunter | G08B 21/22 396/56 |
| 2006/0220834 | A1 * | 10/2006 | Maeng | G08B 25/007 340/539.1 |
| 2010/0201481 | A1 * | 8/2010 | Au | G08C 17/02 340/5.51 |
| 2010/0302025 | A1 * | 12/2010 | Script | G08B 25/005 340/539.1 |
| 2012/0206259 | A1 * | 8/2012 | Gassaway | G08B 25/016 340/540 |
| 2012/0286951 | A1 * | 11/2012 | Hess | G08B 25/14 340/539.1 |
| 2012/0313750 | A1 * | 12/2012 | Au | G08C 17/02 340/5.61 |

(Continued)

*Primary Examiner* — Ojiako K Nwugo
(74) *Attorney, Agent, or Firm* — Barry Choobin; Patent 360

(57) ABSTRACT

An emergency alarm system for generating an alarm in an emergency arising in a restricted space. The system includes an alarm unit and a fob unit. The alarm unit includes a compact and portable housing that can be mounted to any structure of a premise. The alarm unit further includes one or more buzzers for audio alert, a first visual indicator, and a second visual indicator producing different color illuminations. The fob unit can be worn around a neck or arm of a person entering the restricted space. The fob unit includes a button that can be actuated by the person triggering the alarm unit. The first visual indicator can be turned on when the person wearing the fob unit enters the restricted space.

6 Claims, 4 Drawing Sheets

(56) References Cited

U.S. PATENT DOCUMENTS

2014/0076969 A1* 3/2014 Marshall Chesney ..... G07C 9/00904 235/382
2020/0226293 A1* 7/2020 Buenaventura ..... G06F 21/70

* cited by examiner

EMERGENCY ALARM SYSTEM FOR RESTRICTED SPACES

CROSS-REFERENCE TO RELATED APPLICATIONS

This application claims priority to the U.S. provisional Patent Application Ser. No. 62/966,497, filed on Jan. 27, 2020, which is incorporated herein by reference in its entirety.

FIELD OF INVENTION

The present invention relates to an emergency alarm system, and more particularly, the present invention relates to an emergency alert system for restricted enclosed spaces.

BACKGROUND

Restricted spaces herein refer to an enclosed and semi-enclosed space, such as a hall or room within a premise, the inside environment of which can be harmful to humans. For example, certain substances stored in a room can release gases that may be harmful to a person in that room. In another example, harvested forages placed in a silo can produce harmful silo gasses during the early stages of the fermentation process. Access to such enclosed spaces is generally limited to authorized persons only. Moreover, there could be signs and warning both the outside and inside such enclosed spaces.

However, in case of any emergency, the persons inside the restricted enclosed spaces are instructed to leave the place and raise an alarm. Typically, an emergency alarm button may be provided somewhere in a room that can trigger the alarm. The button can be of a contrasting color, such as red, and located on a wall or equipment inside the room. Such an arrangement of the emergency button in a room has several drawbacks. A person must look for such a button around the room. If the inside of the room is dark, locating the button can become impossible. Moreover, due to the immediate health situation of a person, the person may be incapacitated to reach the button. Thus, there is a long-felt need for an emergency alert system for restricted spaces that is devoid of the above drawbacks.

SUMMARY OF THE INVENTION

The following presents a simplified summary of one or more embodiments of the present invention in order to provide a basic understanding of such embodiments. This summary is not an extensive overview of all contemplated embodiments, and is intended to neither identify key or critical elements of all embodiments nor delineate the scope of any or all embodiments. Its sole purpose is to present some concepts of one or more embodiments in a simplified form as a prelude to the more detailed description that is presented later.

It is therefore a principal object of the present invention is directed to an emergency alarm system for restricted space both enclosed and semi-enclosed that is within reach of a person in the restricted space.

It is another object of the present invention that the emergency alarm system provides both audio alert and visual alert.

It is still another object of the present invention that the emergency alarm system can provide automated alerts.

It is a further object of the present invention that the emergency alarm system is economical to manufacture.

It is an additional object of the present invention that the emergency alarm system is easy to install and replace.

It is still an additional object of the present invention that the emergency alarm system is portable.

In one aspect, disclosed is an emergency alarm system and a method of use thereof. The disclosed emergency alarm system includes an alarm unit and a fob unit. The alarm unit includes a compact and portable housing that can be mounted to any structure of a premise. The alarm unit further includes one or more buzzers for audio alert, a first visual indicator, and a second visual indicator, wherein the first visual indicator and the second visual indicator produce different color illumination. The alarm unit can be powered by an enclosed rechargeable battery.

In one aspect, the disclosed emergency alarm system includes two audio buzzers operating at over 108 decibels. The first visual indication produces amber/white illumination, while the second visual indicator produces blue/red illumination.

In one aspect, the fob unit can be configured to be worn around the neck or arm of a person. The fob can include a button to send a signal to the alarm unit. The alarm unit can be triggered to produce audio and visual alerts on receiving the signal. The fob can include an antenna to send the signal to the alarm unit.

In one aspect, the fob can also include a geographical positioning module that can determine if the fob is present in a predefined geographical area. Alternatively, a sensor can be provided within the restricted area which can determine the presence of the fob within the restricted area. Still, in an alternate case, a second button can be provided on the fob that can be activated by a person, wearing the fob, on entering the restricted area.

In one aspect, the alarm unit can include networking circuitry to connect with the fob unit. Alternatively, a routing unit can be provided within the restricted space which can bridge the communication between the alarm unit and the fob unit. The routing unit can also sense the entry and exit of the fob unit in the restricted space.

In one aspect, the fob unit can include a detecting mechanism for harmful substances, and a buzzer, wherein the fob unit can be configured to trigger its buzzer on detecting the harmful substances in the air.

In one aspect, disclosed is a method of operating the emergency alarm system. The fob can be worn around the neck or arm of a person entering a restricted space. On entering the restricted space, the fob can be automatically or manually activated, resulting in turning-on of the first visual indicator. In case of any emergency, the person can press the button on the fob which triggers the two buzzers and the second visual indicator.

These and other objects and advantages of the embodiments herein will become readily apparent from the following detailed description taken in conjunction with the accompanying drawings

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention, since the scope of the invention will be best defined by the allowed claims of any resulting patent.

Figure 1:
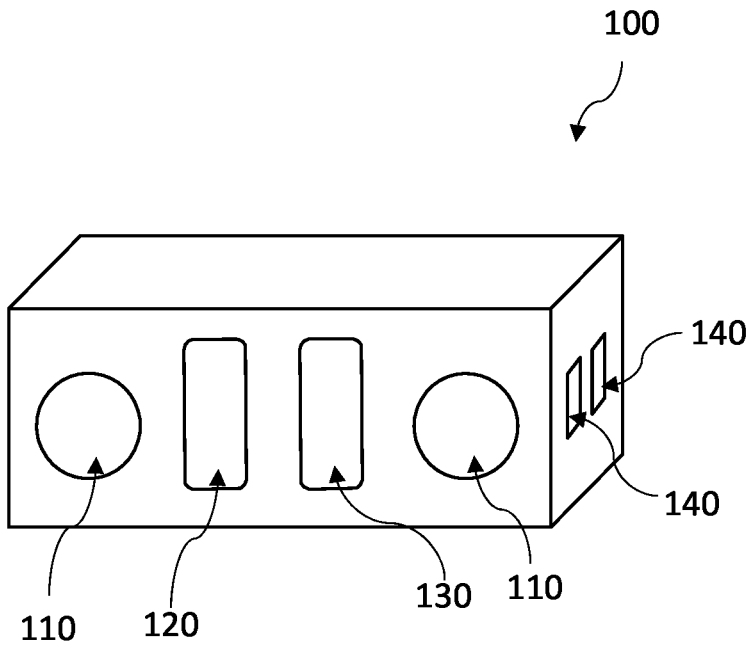
FIG. 1 is a front perspective view of a housing of an alarm unit of the emergency alarm system, according to an exemplary embodiment of the present invention.

Disclosed is an emergency alarm system for restricted spaces including both the enclosed and partially enclosed spaces. The emergency alarm system includes an alarm unit and a fob unit. Referring to FIG. 1 which shows an exemplary embodiment of the housing 100 of the alarm unit. The housing 100 includes cutouts for different components of the disclosed alarm unit. FIG. 1 shows the front of the housing 100 having two cutouts 110 for the buzzers, elongated cutout 120 for the first visual indicator, elongated cutout 130 for the second visual indicator, and two cutouts 140 on the right side of the housing for switches. The housing shown in FIG. 1 is cuboid in shape, however, all kinds of shapes are within the scope of the present invention. For example, the housing 100 can be square, polygonal, or round. The housing can be made from any rigid material, such as plastic or metal.

Figure 2:
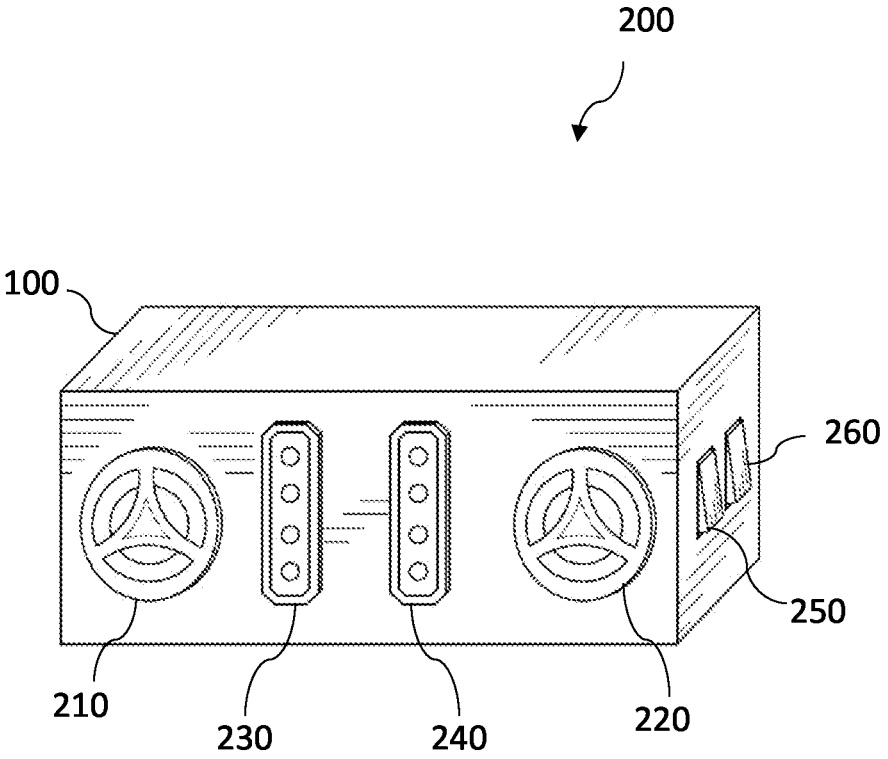
FIG. 2 is a front perspective view of the alarm unit, according to an exemplary embodiment of the present invention.

Referring to FIG. 2 which shows an exemplary embodiment of the alarm unit 200. The alarm unit includes the housing 100 enclosing two buzzers 210 on its front side. The buzzers can be mounted over the cutout in the housing, as shown in FIG. 1. The two buzzers are shown at extreme ends of the front side, however, the position of the buzzers can be changed. The buzzers are configured to produce a strong sound, alerting the persons nearby the alarm unit. For example, the sound of the buzzer can warn persons inside the premises where the restricted space is located. It is to be understood that FIG. 1 shows two buzzers but one, three, or more buzzers are within the scope of the present invention. Moreover, one or more buzzers can be provided on different sides of the housing. In one case, the buzzer can produce a sound similar to a siren. In one case, the siren can operate at over 108 decibels. The sound of the buzzers can notify the emergency personnel inside the premises to reach the location of the emergency.

FIG. 2 also shows a first visual indicator 230 adjacent to the buzzer. The first visual indicator 230 can produce an amber/white illumination. The first visual indicator 230 can lit whenever the fob unit enters the restricted premises. The first visual indicator 230 can indicate the presence of a person in the restricted area. The second visual indicator 240 can have a blue/red illumination and can indicate the emergency. The second visual indicator 240 can be triggered through the fob unit. The second visual indicator 240 can also blink at a suitable frequency for alerting emergency persons about the emergency. On the right side of the housing 100 can be seen two switches. A first switch 250 can be a test switch and used to test the working of the disclosed emergency alarm system. The second switch 260 can be used to turn the second visual indicator 240 on and off. The second switch can be in serial connection with the conductors extending from a battery inside the housing 100 for turning the supply of power to the alarm unit on and off.

Figure 3:
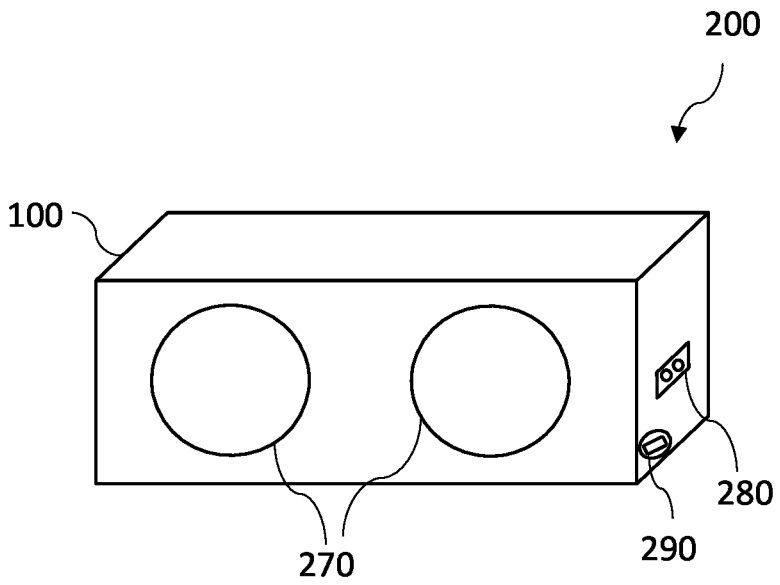
FIG. 3 is a rear view of the alarm unit shown in FIG. 2, according to an exemplary embodiment of the present invention.

FIG. 3 shows a rear side of the alarm unit 200 having a pair of magnets mounted to the rear side of the housing 100. The magnets permit the alarm unit to be mounted to an upstanding structure, such as a wall or door of the premises. The magnets can be magnetically engaged to other magnets or iron plates. Thus, the alarm unit can be easily mounted on an iron plate coupled to an upstanding structure. The alarm unit 200 can also be easily removed and replaced without any tools. It is to be understood that the magnets can be replaced by any other fastening means without departing from the scope of the present invention. For example, hook and loop fasteners, brackets, and like can also be incorporated in the housing for mounting the alarm unit to an upstanding structure. In one case, the alarm unit can be mounted to an outer side of the wall or door of the restricted spaces. In one case, the alarm unit can be mounted above the door. On the sidewall of the housing 100 in FIG. 3 is shown a recharging port 290 and indicator lights 280. The indicator lights 280 can show the status of the alarm unit, such as the alarm unit is active and working. One of the two indicator lights can show a malfunction of the alarm unit. More than one indicator lights can be provided in the housing, for example, Battery indicators to show the charge level of the battery, such as full, half, and empty. The battery level can also be numerically displayed.

Figure 4:
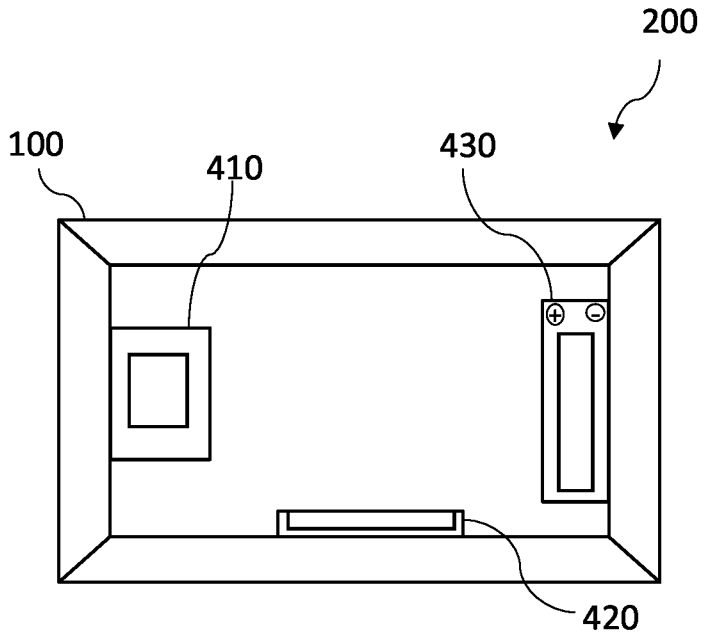
FIG. 4 shows the interior of the alarm unit shown in FIG. 2, according to an exemplary embodiment of the present invention.

FIG. 4 shows the interior of the alarm unit 200 having a control unit 410, a network circuitry 420, and an internal battery 430. The control unit 410 includes a relay for controlling the operation of the alarm unit. The network circuitry permits wirelessly receiving signals from the fob unit. The alarm unit can be powered by an internal rechargeable battery, such as a lithium-ion battery of suitable capacity. The use of batteries makes the alarm unit portable and compact. No wiring or electrical connection is needed, and the alarm unit can be easily installed anywhere without the need for electrical points.

Figure 5:
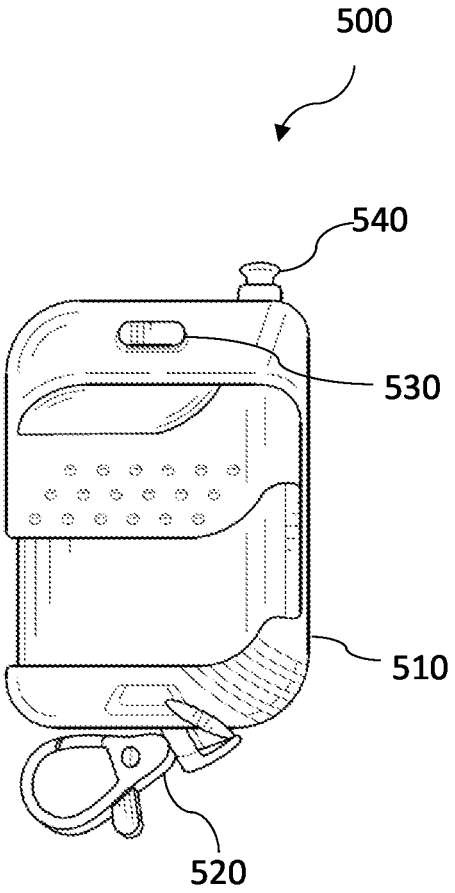
FIG. 5 shows a fob unit of the emergency alarm system, according to an exemplary embodiment of the present invention.

Referring to FIG. 5, which shows the fob unit 500 of the disclosed emergency alarm system. The fob unit 500 can be configured to be worn around the neck or arm of a person entering a restricted space. The fob unit is configured to wirelessly send signals to the alarm unit for trigging the one or more functions of the alarm unit. The fob unit 500 can include a housing 510 having a hook 520 configured in the housing 510. Furthermore, it can be seen in FIG. 5 is button 530 that can be pressed by the person wearing the fob. The actuation of button 530 can trigger the alarm unit indicating the emergency.

The fob unit 500 can include a network circuitry that allows sending signals to the alarm unit. FIG. 5 shows an antenna 540 for sending a signal to the alarm unit. When the fob unit enters the restricted area, a signal can be sent from the fob unit to the alarm unit triggering the first visual indicator of the alarm unit. The turning-on of the first visual indicator shows the presence of a person, wearing the fob unit, is inside the restricted space. The signal to activate the first visual indicator can be automatically sent by the fob unit when the person enters the restricted space. Alternatively, the person can manually interact with the fob unit for transferring the signal. To automatically send the signal, the fob unit can include a sensor that can detect the entry of the fob unit into the restricted space. For example, the fob unit can include a positioning module that can detect the current position of the fob unit in the geographical area of the restricted space. Additionally, the positioning module can detect the trail of the person entering the restricted space. Upon determining the current position of the fob in the restricted space, the fob unit through the antenna can send the signal to the alarm unit. In an alternate embodiment, a routing unit can be provided in the restricted space. The routing unit can bridge the communication from the fob unit to the alarm unit. The routing unit can detect the entry of the fob unit in the restricted space and communicate the same to the alarm unit.

During an emergency, the person wearing the fob can press button 530 in the fob unit which sends a second signal to the alarm unit triggering the buzzers and the second visual indicator. The fob unit can also include a detector to sense the accidental release of harmful gases in the air and in response trigger an inbuilt buzzer. For example, the fob unit can detect silo gasses in a silo and trigger both the buzzer in the alarm unit and a buzzer in the fob unit. This alerts the person in the silo and outside the silo to vacate the place.

The fob unit can be powered by an inbuilt battery which can be rechargeable or replaceable. In case, the battery is chargeable, the fob unit can have a recharging point. Similarly, the batteries in the alarm unit can be charged. The alarm unit can also have a test button 250 to test the functioning of the disclosed emergency alarm system. This may ensure that the emergency alarm system is working properly.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. An emergency alarm system for a restricted space in premise, the emergency alarm system comprising: an alarm unit; and a fob unit configured to be worn around neck or arm of a person entering the restricted space, the alarm unit comprising: a housing having a coupling member configured to mount the alarm unit to a structure in the premise, one or more buzzers encased in the housing, the one or more buzzers operably coupled to a control unit also encased in the housing, a rechargeable battery for powering the alarm unit, a first visual indicator coupled to the housing and operably coupled to the control unit, and a second visual indicator coupled to the housing and operably coupled to the control unit, the fob unit comprising: a button configured to generate a first signal on actuation, and an antenna configured to send the first signal to the alarm unit, wherein the alarm unit triggers the second visual indicator and the one or more buzzers in response to the first signal wherein the fob unit is configured to send a second signal to the alarm unit in response to entry of the fob unit in the restricted space, wherein the alarm unit is configured to turn-on the first visual indicator in response to the second signal.

2. The emergency alarm system according to claim 1, wherein the fob unit comprises a positioning module configured to detect the entry of the fob unit in a geographical area of the restricted space, wherein the positioning module generates the second signal.

3. The emergency alarm system according to claim 1, wherein the fob unit comprises a second button, wherein the second button is configured to generate the second signal on actuation.

4. The emergency alarm system according to claim 1, wherein the first visual indicator is having an amber or white color illumination, and the second visual indicator is having a blue or red color illumination.

5. The emergency alarm system according to claim 1, wherein the emergency alarm system further comprises a routing unit configured to bridge communication from the fob unit to the alarm unit, wherein the routing unit is configured to detect entry of the fob unit in the restricted space and in response send a second signal to the alarm unit, the alarm unit in response to the second signal turns-on the first visual indicator.

6. The emergency alarm system according to claim 1, wherein the fob unit further comprises a miniature buzzer and a chemical detector, wherein the chemical detector is configured to detect harmful gases and in response triggers the miniature buzzer.

* * * * *